US005791512A

United States Patent [19]

Kanatsuka

[11] Patent Number: 5,791,512

[45] Date of Patent: Aug. 11, 1998

[54] AUTOMATIC VENDING EQUIPMENT

[75] Inventor: Tsuneo Kanatsuka, Tamatsukuri-machi, Japan

[73] Assignee: Silk Co., Ltd., Ibaraki, Japan

[21] Appl. No.: 762,821

[22] Filed: Dec. 9, 1996

[30] Foreign Application Priority Data

Dec. 14, 1995 [JP] Japan ..... 7-325490
Oct. 18, 1996 [JP] Japan ..... 8-275674

[51] Int. Cl.[6] ..... G07F 11/00

[52] U.S. Cl. ..... 221/2; 414/276; 414/281; 221/130; 221/131; 221/155; 221/191; 221/194; 221/258; 221/301; 221/298

[58] Field of Search ..... 186/55, 56; 221/2, 221/7, 13, 131, 133, 155, 191, 192, 194, 258, 298, 301; 414/276, 281

[56] References Cited

U.S. PATENT DOCUMENTS

| | | | |
|---|---|---|---|
| 3,674,159 | 7/1972 | Lemelson, Jr. | 414/276 |
| 3,750,804 | 8/1973 | Lemelson | 414/276 |
| 3,964,577 | 6/1976 | Bengtsson | 186/56 |
| 4,252,250 | 2/1981 | Bartholomew | 221/13 |
| 4,681,504 | 7/1987 | Welch | 414/276 |

FOREIGN PATENT DOCUMENTS

| | | | |
|---|---|---|---|
| 939622 | 1/1974 | Canada | 414/204 |
| 62304 | 3/1990 | Japan | 414/276 |
| 183891 | 7/1990 | Japan | 221/130 |
| 189897 | 8/1991 | Japan | 221/130 |

*Primary Examiner*—H. Grant Skaggs
*Attorney, Agent, or Firm*—Oblon, Spivak, McClelland, Maier & Neustadt, P.C.

[57] ABSTRACT

There are used article display shelves each comprising a plurality of article storing compartments arranged vertically and laterally, the article storing compartments each holding a plurality of articles in a front-declined state, and the articles in each article storing compartment are held by means of a stopper, the stopper being capable of moving between an article holding position for inhibiting free fall of article and an article release position for permitting free fall of article. On the premise that money is paid, a bucket is conveyed to a position where a desired article is to be dropped from the article storing compartment which holds the article, and the position of the stopper is shifted to the article release position by an operation performed on the bucket side. As a result, the desired article is put into the bucket, which bucket is then conveyed up to an article take-out port. In this way the sale of article is effected. Thus, the expensive drive source included in the stopper displacing structure, namely, the structure for taking out a desired article from the associated article display shelf, is provided on only the bucket and hence it is possible to provide a less expensive, large-sized, automatic vending equipment.

23 Claims, 11 Drawing Sheets

AUTOMATIC VENDING EQUIPMENT

BACKGROUND OF THE INVENTION

1. Field of the Invention

The present invention relates to a large-sized automatic vending equipment capable of handling various kinds of articles and more particularly to an automatic vending equipment of the type in which articles are conveyed using a bucket from article display shelves which store the articles and are supplied to a customer.

2. Description of the Prior Art

As a conventional vending machine, a small-sized one is popular which handles only specific kinds of articles such as juice and tobacco. Also as to a large-sized automatic vending equipment capable of handling various kinds of articles, there have been made various proposals. Such a large-sized automatic vending equipment is disclosed, for example, in Japanese Patent Laid Open Nos.79398/1975, 70097/1975 and 128199/1977, Japanese Utility Model Laid Open No. 21596/1978, Japanese Patent Laid Open Nos. 38296/1977 and 184595/1992.

A large-sized automatic vending equipment has, as basic common structures, plural stages of article display shelves, a structure for taking out a desired article from an article display shelf, and a structure for conveying the article thus taken out up to an article take-out port. In the aforesaid publications there are disclosed, as structures for conveying the taken-out article up to the article take-out port, a structure using a belt conveyor (Japanese Patent Laid Open No.79398/1975), a structure using a bucket (Japanese Patent Laid Open Nos.70097/1975 and 128199/1977 and Utility Model Laid Open No.21596/1978), and a combined structure of the two (Japanese Patent Laid Open Nos.38296/1977 and 184595/1992).

Such conventional structures involve the following problems. In the automatic vending equipment disclosed in the above publications, the structure for taking out a desired article from an article display shelf is required at least one for each article display shelf. However, since this structure includes expensive solenoid and actuator as a drive source, there is the problem that the cost of the drive source and that of components for required wiring, etc. are extremely high.

Further, an automatic vending equipment usually adopts a structure in which article display shelves, etc. are accommodated within a box-shaped body case whose one side is open, and a transparent glass or plastic plate is mounted along the opening of the body case. However, with increase in size of the equipment there arises the problem that the cost of materials for forming the body case becomes high, thus leading to increase of the material cost in the case of a large-sized automatic vending equipment.

SUMMARY OF THE INVENTION

It is an object of the present invention to provide less expensively a large-sized automatic vending equipment capable of handling various kinds of articles.

It is another object of the present invention to provide an automatic vending equipment capable of quick supply of desired articles to a customer.

It is a further object of the present invention to constitute a store itself as an automatic vending equipment.

It is a still further object of the present invention to provide an automatic vending equipment capable of preventing an erroneous supply of article.

It is a still further object of the present invention to provide an automatic vending equipment which permits a customer to take out articles easily.

It is a still further object of the present invention to provide an automatic vending equipment which permits a customer to take out articles safely.

It is a still further object of the present invention to provide an automatic vending equipment superior in anti-crime performance.

According to the present invention, in one aspect thereof, there is provided an automatic vending equipment comprising:

article display shelves each including a plurality of article storing compartments formed in a matrix form vertically and laterally for holding a plurality of articles in a front-declined state;

an article dropping mechanism provided in each of the article storing compartments, the article dropping mechanism having a stopper capable of moving between an article holding position for inhibiting free fall of article and an article release position for permitting free fall of article, stopper urging means for urging the stopper to the article holding position, and stopper displacing means which when pressed displaces the stopper to the article release position;

an article take-out port for taking out articles;

bucket conveying means for conveying an article receiving bucket to an article dropping position where an article is dropped into the bucket from the article storing compartment which holds the article, and also to the article take-out port;

pressing means attached to the bucket to impart a pressing force to the stopper displacing means in the article dropping mechanism;

a front panel which covers all of the article display shelves, the article dropping mechanism and the bucket conveying means and which allows the article take-out port to be exposed;

article designating keys;

money receiving means; and article selling means which causes the bucket conveyance by the bucket conveying means and the displacement of the stopper to the article release position by the pressing means to be executed and which causes each article designated by the article designating keys to be conveyed up to the article take-out port on condition that the amount of money corresponding to the designated article is received by the money receiving means.

According to this construction, when a desired article is conveyed from the associated article storing compartment up to the article dropping position, the stopper is displaced to the article release position by an operation performed on the bucket side, namely, as a result of the stopper displacing means being pressed by the pressing means, and the article is received and held in the bucket. After all of desired articles are received and held in the bucket in the same manner as above, those articles are conveyed up to the article take-out port by conveyance of the bucket, whereby the selling of the articles is effected. In this case, the drive source included in the structure necessary for taking out the desired articles from article display shelves is provided on only the bucket, so that the number of components is reduced markedly and the component cost becomes much lower in comparison with the case where such drive source is provided for each of the article storing compartments in each article display shelf.

In another aspect of the present invention there is provided an automatic vending equipment comprising:

article display shelves each including a plurality of article storing compartments formed in a matrix form vertically and laterally for holding a plurality of articles in a front-declined state;

an article dropping mechanism provided in each of the article storing compartments, the article dropping mechanism having a stopper capable of moving between an article holding position for inhibiting free fall of article and an article release position for permitting free fall of article, stopper urging means for urging the stopper to the article holding position, and stopper displacing means which when pressed displaces the stopper to the article release position;

an article take-out port for taking out articles;

a bucket support and moving mechanism for supporting an article receiving bucket movably to an article dropping position where an article is dropped into the bucket from the article storing compartment which holds the article, and also to the article take-out port;

a bucket driving unit for driving the bucket support and moving mechanism;

a pressing mechanism attached to the bucket and displaceable in a direction to impart a pressing force to the stopper displacing means in the article dropping mechanism;

a pressing mechanism driving unit for driving the pressing mechanism;

a front panel which covers all of the article display shelves, the article dropping mechanism and the bucket conveying means and which allows the article take-out port to be exposed;

article designating keys;

money receiving means; and article selling means which applies drive control signals to both the bucket driving unit and the pressing mechanism driving unit, thereby causing the bucket conveyance by the bucket support and moving mechanism and the displacement of the stopper to the article release position by the pressing mechanism to be executed and causing each article designated by the article designating keys to be conveyed up to the article take-out port on condition that the amount of money corresponding to the designated article is received by the money receiving means.

According to this construction, when a desired article is conveyed from the associated article storing compartment up to the article dropping position, the stopper is displaced to the article release position by an operation performed on the bucket side, namely, as a result of the stopper displacing means being pressed by the pressing means, and the article is received and held in the bucket. After all of desired articles are received and held in the bucket in the same manner as above, those articles are conveyed up to the article take-out port by conveyance of the bucket, whereby the selling of the articles is effected. In this case, the drive unit for the pressing mechanism necessary for taking out the desired articles from article display shelves is provided on only the bucket, so that the number of components is reduced markedly and the component cost becomes much lower as compared with the case where such drive source is provided for each of the article storing compartments in the showcase.

In a further aspect of the present invention, there is provided an automatic vending equipment comprising:

article display shelves each including a plurality of article storing compartments for holding a plurality of articles in an oblique state;

an article dropping mechanism provided in each of the article storing compartments, the article dropping mechanism having a stopper capable of moving between an article holding position for inhibiting free fall of article and an article release position for permitting free fall of article, stopper urging means for urging the stopper to the article holding position, and stopper displacing means which when pressed displaces the stopper to the article release position;

an article take-out port for taking out articles;

a bucket support and moving mechanism for supporting an article receiving bucket movably to an article dropping position where an article is dropped into the bucket from the article storing compartment which holds the article, and also to the article take-out port;

a bucket driving unit for driving the bucket support and moving mechanism;

pressing means attached to the bucket and displaceable in a direction to impart a pressing force to the stopper displacing means in the article dropping mechanism;

a pressing mechanism driving unit for driving the pressing mechanism;

article designating means;

money receiving means; and article selling means which applies drive control signals to both the bucket driving unit and the pressing mechanism driving unit, thereby causing the bucket conveyance by the bucket conveying means and the displacement of the stopper to the article release position by the pressing mechanism to be executed and causing each article designated by the article designating means to be conveyed up to the article take-out port on condition that the amount of money corresponding to the designated article is received by the money receiving means.

According to this construction, when a desired article is conveyed from the associated article storing compartment up to the article dropping position, the stopper is displaced to the article release position by an operation performed on the bucket side, namely, as a result of the stopper displacing means being pressed by the pressing means, and the article is received and held in the bucket. After all of desired articles are received and held in the bucket in the same manner as above, those articles are conveyed up to the article take-out port by conveyance of the bucket, whereby the selling of the articles is effected. In this case, the drive unit for the pressing unit necessary for taking out the desired articles from article display shelves is provided on only the bucket, so that the number of components is reduced markedly and the component cost becomes much lower as compared with the case where such drive source is provided for each of the article storing compartments in each article display shelf.

DETAILED DESCRIPTION OF PREFERRED EMBODIMENTS

Figure 1:
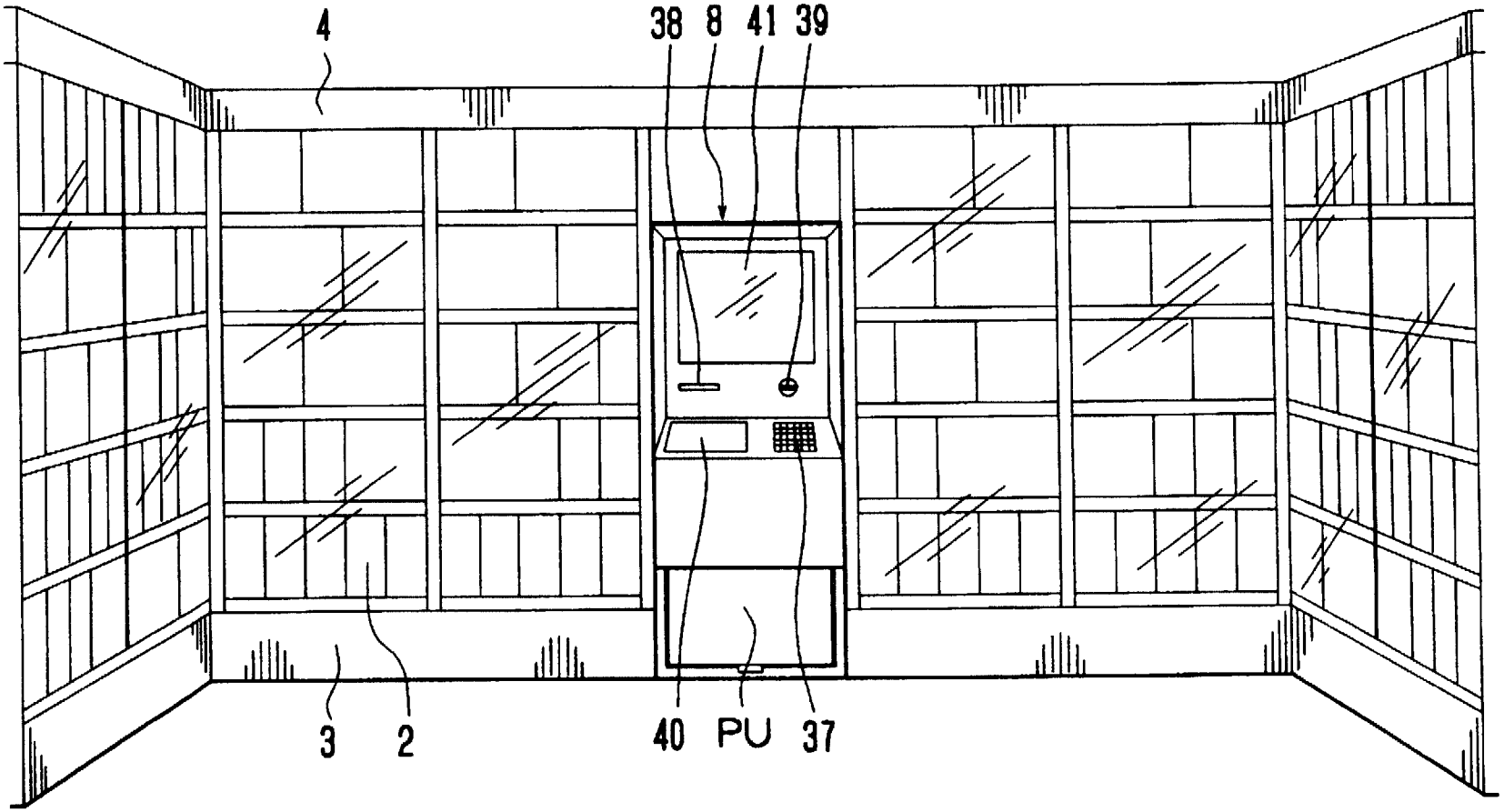
FIG. 1 is a front view showing an appearance of the whole of an automatic vending equipment according to a first embodiment of the present invention.
Figure 2:
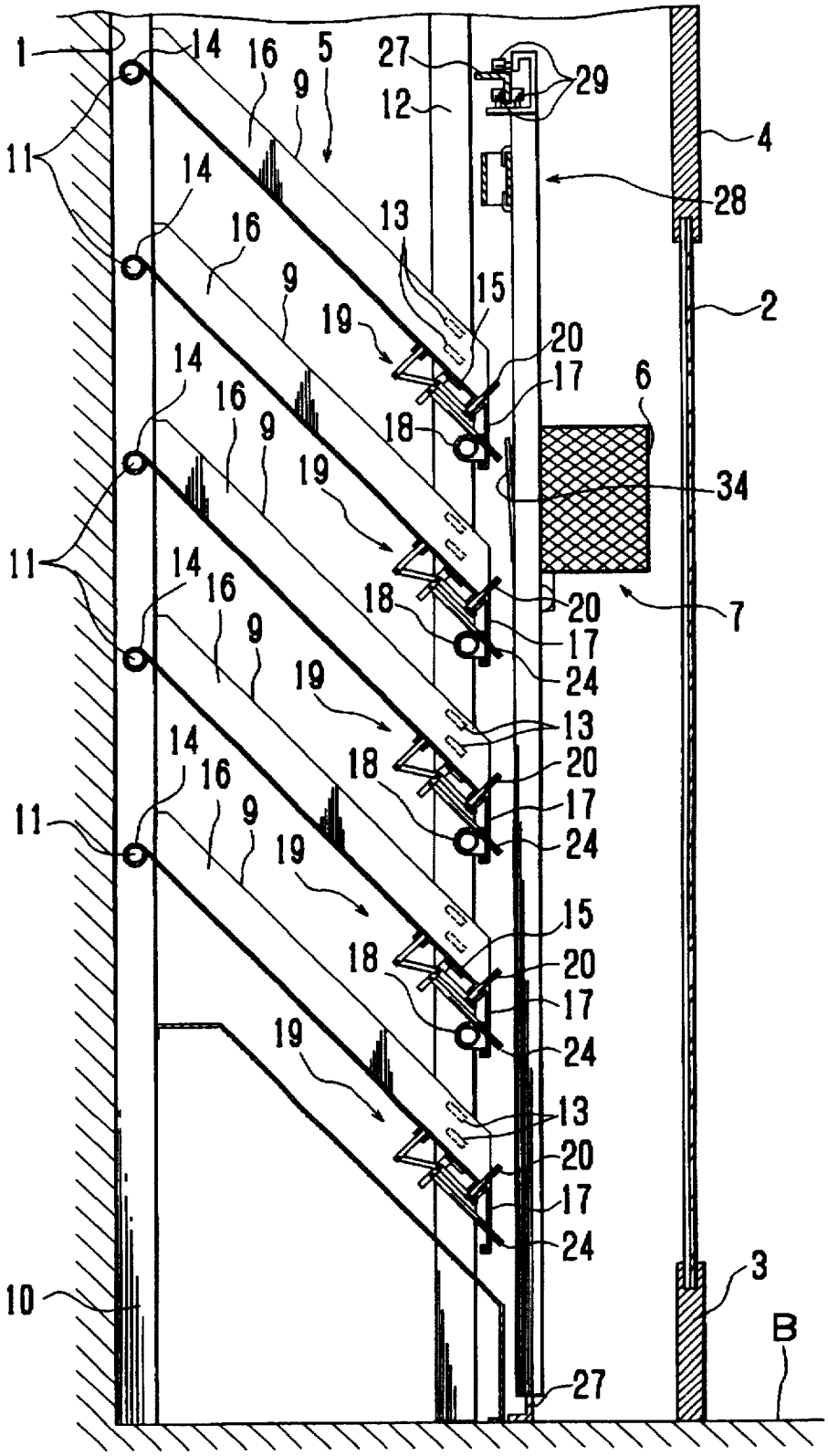
FIG. 2 is a side view in vertical section of the entire equipment.
Figure 3:
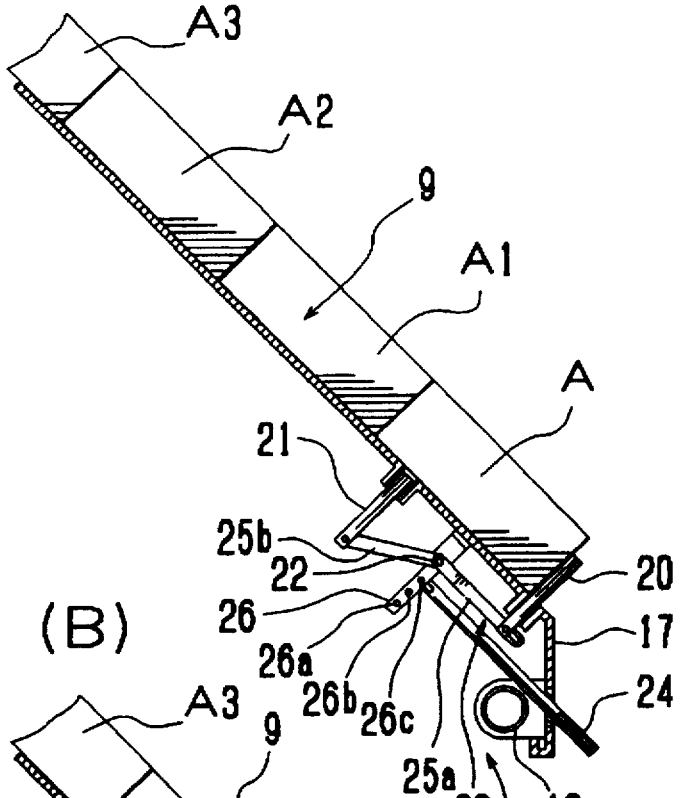
FIG. 3(A) is a side view in vertical section of an article dropping mechanism, showing a stand-by state in which a stopper is located at an article holding position.
FIG. 3(B) is a side view in vertical section of the article dropping mechanism, showing an article dropping state in which the stopper is located at an article release position.
Figure 3:
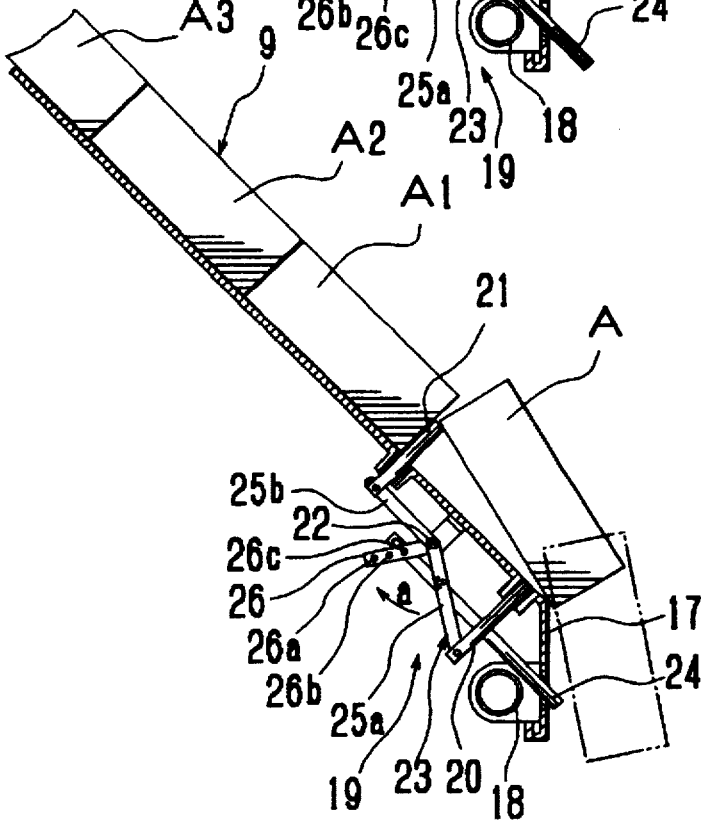
Figure 4:
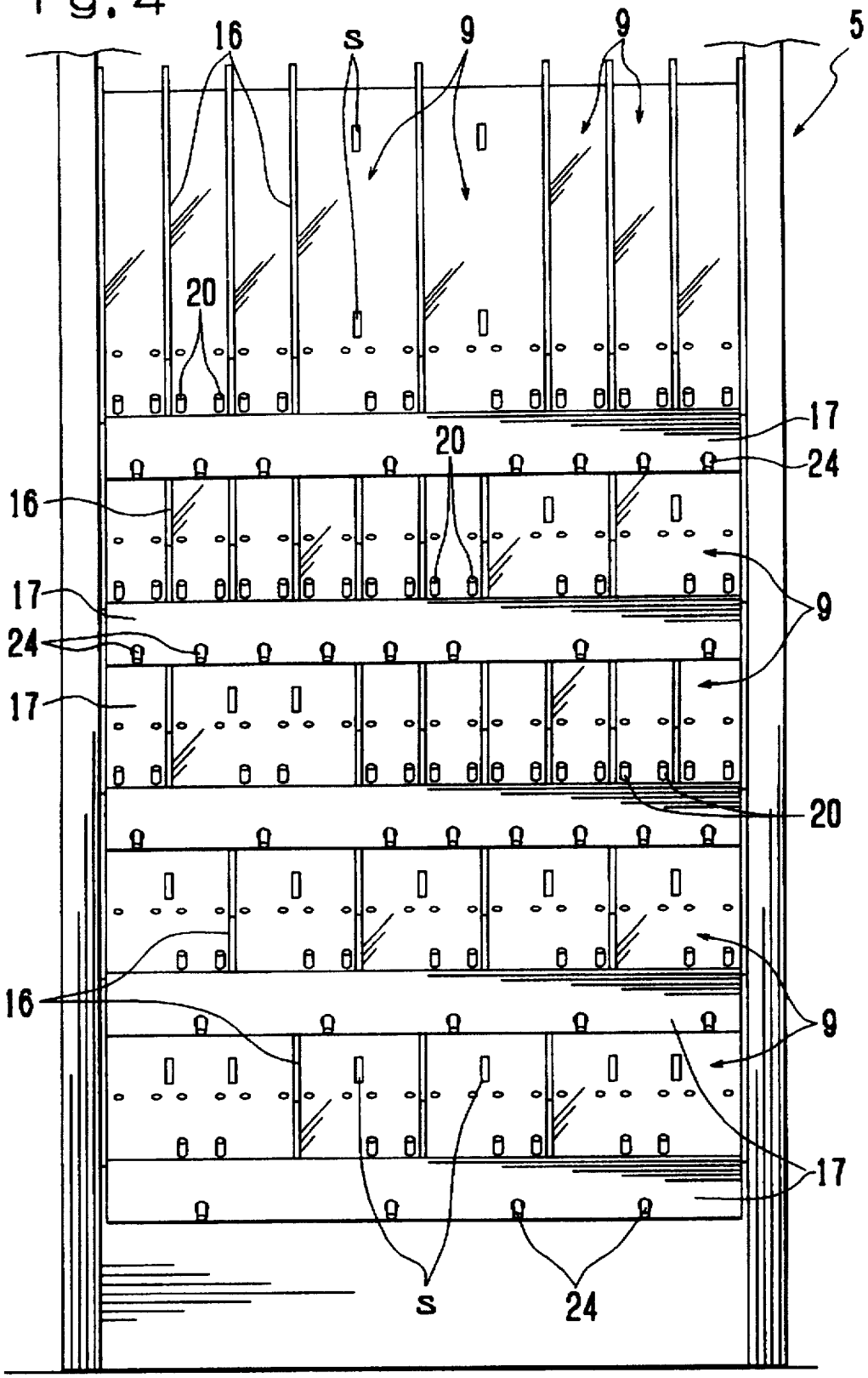
FIG. 4 is a front view showing article display shelves on a larger scale.
Figure 5:
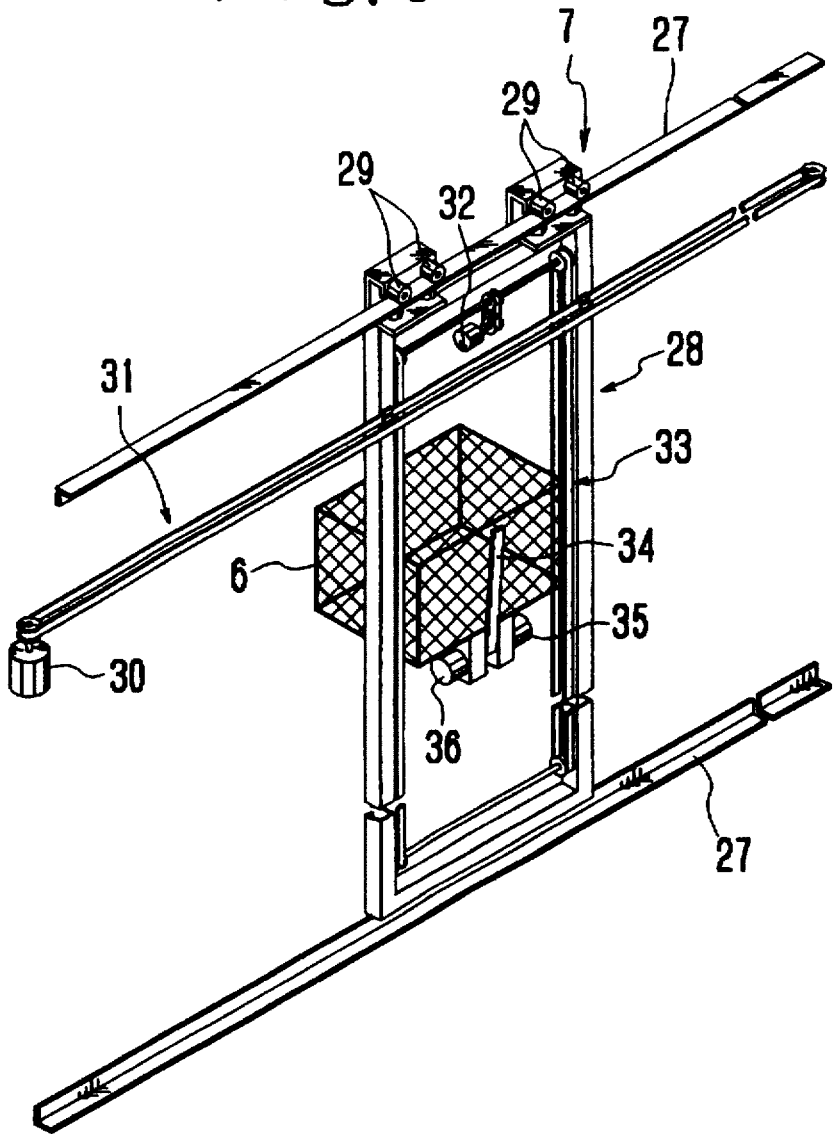
FIG. 5 is a perspective view basically showing a bucket conveying structure.
Figure 6:
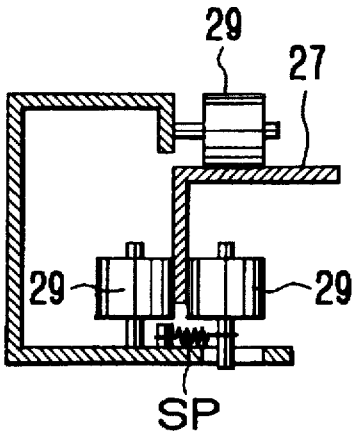
FIG. 6 is a side view in vertical section showing a structure for mounting a bucket carrier to a bucket rail.
Figure 7:
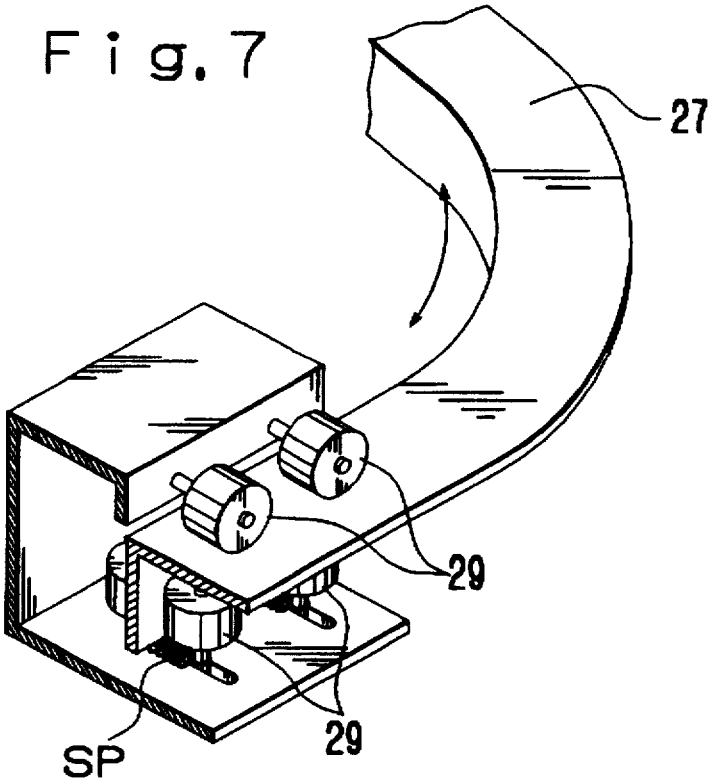
FIG. 7 is a perspective view showing the bucket conveyor mounting structure for the bucket rail.
Figure 8:
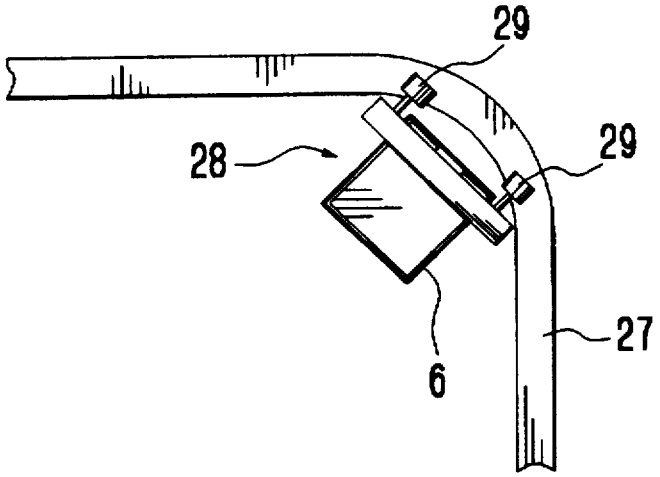
FIG. 8 is a plan view showing the bucket carrier positioned on a bent portion of a bucket rail.
Figure 9:
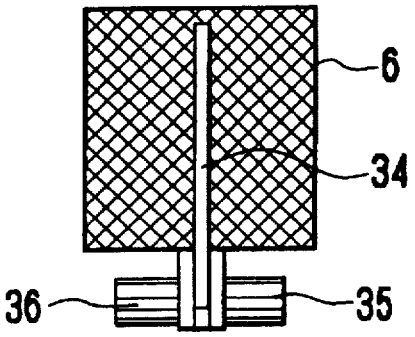
FIG. 9 is a rear view of the bucket.
Figure 10:
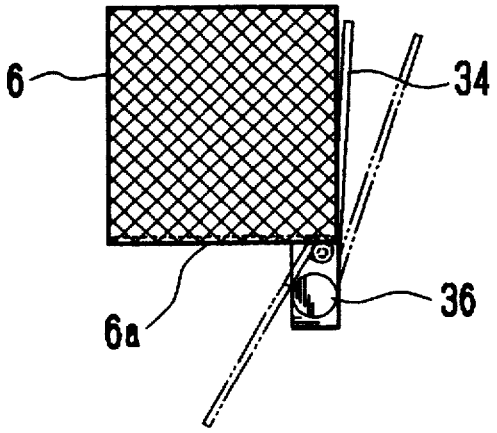
FIG. 10 is a side view of the bucket.

An automatic vending equipment according to a first embodiment of the present invention will be described below with reference to FIGS. 1 to 10. FIG. 1 is a front view showing an appearance of the whole of the automatic vending equipment, FIG. 2 is a vertically sectional side view thereof, FIG. 3 is a vertically sectional side view of an article dropping mechanism, in which (A) shows a stand-by state in which a stopper is located at an article holding position and (B) shows an article dropping state in which the stopper is located an article release position, FIG. 4 is a front view showing article display shelves on a larger scale, FIG. 5 is a perspective view basically showing a bucket conveying structure, FIG. 6 is a vertically sectional side view showing a structure for mounting a bucket frame to a bucket rail, FIG. 7 is a perspective view thereof, FIG. 8 is a plan view of the bucket conveyor positioned in a bent portion of the bucket rail, FIG. 9 is a rear view of the bucket, and FIG. 10 is a side view of the bucket.

The automatic vending equipment of this embodiment has such appearance and construction as shown in FIG. 1. More specifically, transparent panels 2 as front panels formed of glass or a plastic material for example are disposed along three wall surfaces 1 in a room and are held slidably by both a lower rail member 3 laid on a floor surface B and an upper rail member 4 laid on a ceiling surface (see FIG. 2). Behind the transparent panels 2 are disposed article display shelves 5 for storing and displaying a large number of various articles A and a bucket conveying means 7 for conveying a bucket 6 which is used for taking out the articles A (neither shown in FIG. 1). In the central article display shelves, there is centrally disposed an operation display section 8 which accepts various operations and displays predetermined information. When a customer designates in the operation display section 8 an article A displayed in an article display shelf 5 which article is seen through the transparent panel 2, the automatic vending equipment, on condition that the amount of money corresponding to the designated article A is received in the operation display section 8, causes the bucket 6 to move up to the position of the designated article A, then causes the article A to fall from the article display shelf into the bucket 6 and to be held therein, and causes the bucket 6 to move up to an article take-out port PU positioned under the operation display section 8, thereby permitting the supply of the article A. The following description is now provided about a construction which makes it possible to perform such basic operations.

The article display shelves 5 are arranged in front of three wall surfaces 1 in the room. Each of the article display shelves 5 has a plurality of article storing compartments 9 which are arranged in a matrix form vertically and laterally and in a front-declined state.

The structure of each article display shelf 5 will now be described with reference to FIGS. 2 and 4. Substantially in contact with and in front of each wall surface 1 are erected a plurality of rear frames 10, and between adjacent rear frames 10 are vertically arranged and fixed a plurality of horizontal support frames 11. In front positions spaced a predetermined distance from the wall surface 1 are erected a plurality of front frames 12, and a large number of angle adjusting apertures 13 are formed vertically in the front frames 12. Further, a hook portion 14 formed at the rear end of the article display shelf 5 is hooked pivotably to the associated support frame 11, and the front portion of the article display shelf 5 is supported by a support piece 15 which is locked detachably to an angle adjusting aperture 13. The area for the display of articles A in the article display shelf 5 is partitioned into plural compartments by partition plates 16 to form article storing compartments 9. Projections (not shown) formed at lower edges of the partition plates 16 are brought into engagement with slits S formed in the article display shelf 5, whereby the partition plates 16 are secured detachably to the article display shelf. In the case where a large-sized article A is to be displayed, a required number of partition plates 16 are removed to give a space wide enough to display the large-sized article. At the front end portion of the article display shelf 5 there is formed a blind plate 17 which is bent downward. On the back side of each blind plate 17 is mounted a fluorescent lamp 18 for illuminating articles A stored in the underlying article storing compartments 9. Where required for the improvement of beauty, color panels or the like are affixed to the wall surface 1 constituting a rear portion of the automatic vending equipment.

On the back side of the front end portion of the article display shelf 5 there is mounted an article dropping mechanism 19 for dropping the articles A displayed in the article display shelf 5. For each article storing compartment 9 is disposed one article dropping mechanism 19.

A description will now be given of the article dropping mechanisms 19 with reference to FIGS. 2, 3 and 4. The article dropping mechanisms 19 each comprise a stopper 20, a second stopper 21, a pivotable member 23 which is a connection member pivotable about a pivot shaft 22, and a stopper displacing means 24 for pivotally moving the pivotable member 23. The stopper 20, which comprises two rods, is positioned at the front end portion of the article display shelf 5 and is movable between an article holding position projecting upward from the surface of the associated article storing compartment 9 and an article release position lower than the surface of the article display shelf 5.

The second stopper 21, which also comprises two rods, is disposed at an upper position spaced a predetermined distance from the stopper 20 along the inclination of the article display shelf 5 and is movable between an article push-up position projecting upward from the surface of the article display shelf 5 and an article push-up cancel position lower than the shelf surface. The pivotable member 23 is provided with a pair of first link 25*a* and second link 25*b* which are disposed side by side in the horizontal direction and fixed to each other. To the front end of the first link 25*a* is connected the stopper 20 pivotably and to a distal end of the second link 25*b* is connected the second stopper 21 pivotably. The pivotable member 23 is further provided with a link 26 extending from between the first link 25*a* and second link 25*b*. Three connection holes 26*a*, 26*b* and 26*c* are formed in the link 26. The stopper displacing means 24 is a rod-like member and one end thereof is pivotably connected selectively to the connection holes 26*a*, 26*b* and 26*c* of the link 26, while the opposite end thereof extends forward through the blind plate 17. The pivotable member 23 is urged forward by a stopper urging means (not shown). Therefore, the article dropping mechanism 19 is usually maintained in its state shown in FIG. 3(A) in which the stopper 20 projects from the surface of the article storing compartment 9 and the second stopper 21 is retracted from the compartment surface. The article dropping mechanism is hidden by the blind plate so as not to be seen from the front side.

The details of the bucket conveying means 7 will now be described with reference to FIG. 2 and FIGS. 5 to 10. First, a pair of upper and lower bucket rails 27 are disposed opposedly to the article display shelves 5, and a bucket carrier 28 which supports the bucket 6 is mounted slidably to the bucket rails 27. In the bucket carrier 28, a pulley (not shown) is fitted in the lower bucket rail 27, while to the upper bucket rail 27 the bucket carrier 28 is mounted by such a mounting structure as shown in FIGS. 6 and 7, which structure uses a plurality of rollers 29 in a sandwiching relation to the upper bucket rail 27. Since the article display shelves 5 are arranged in a generally turned square U-shape, the bucket rail 27 is also laid substantially in turned square U-shape. Therefore, in a bent position of the bucket rail 27 the bucket carrier 28 assumes such a state as illustrated in FIG. 8. To permit such a state of the bucket carrier 28, the pulley (not shown) fitted in the lower bucket rail 27 is capable of tilting by a predetermined angle relative to the bucket advancing direction. Some of the rollers 29 which hold the upper bucket rail 27 in a sandwiching fashion are displaceable while being urged by springs SP. The bucket carrier 28 slides along the upper and lower bucket rails 27 by means of an X-axis belt conveyor mechanism 31 which is driven by an X-axis motor 30. The bucket 6 is attached to the bucket carrier 28 vertically movably. As a structure for realizing this vertical movement a Y-axis belt conveyor mechanism 33 is provided in the bucket carrier 28. The Y-axis belt conveyor mechanism 33 is driven by a Y-axis motor 32. Thus, the bucket conveying means 7 is made up of a bucket support and moving mechanism which supports the bucket 6 movably and a bucket drive unit for driving the bucket support and moving mechanism. More specifically, the bucket support and moving mechanism comprises the bucket carrier 28, bucket rails 27, X-axis belt conveyor mechanism 31 and Y-axis belt conveyor mechanism 33, while the bucket drive unit comprises the X-axis motor 30 and Y-axis motor 32.

An actuator 34, which serves as a pressing mechanism capable of moving into contact with and away from the article display shelves 5, and an actuator drive motor 35 are attached to the bucket 6. The actuator 34 and the actuator drive motor 35 constitute a pressing means. The actuator 34 is driven by the actuator drive motor 35 and thereby presses the stopper displacing means 24 in the article dropping mechanism 19. Further, a bottom plate 6*a* of the bucket 6 can be opened and closed by using as a drive source a bottom plate drive motor 36 attached to the underside of the bucket 6.

The operations of the X-axis motor 30, Y-axis motor 32, actuator drive motor 35 and bottom plate drive motor 36 are controlled by a microcomputer (not shown) which is incorporated in the operation display section 8. The transmission of control signals from the microcomputer to the motors 32, 35, 36 and the supply of a driving power to those motors are performed by a trolley wire mechanism (not shown) disposed along the upper bucket rail 27.

Reference will now be made to the operation display section 8. The operation display section 8 incorporates the aforesaid microcomputer therein and is provided with article designating keys 37 for designating a desired article A out of the articles displayed on the article display shelves, a paper money inlet slot 38 and a coin inlet slot 39 both as money inlet slots, a guidance display 40 for the display of operation procedure, etc., and a designated article display 41 for displaying a list of designated articles A, the amount of money, etc. The article designating keys 37 function as an article designating means. Paper money and coins received through the paper money inlet slot 38 and the coin inlet slot 39 are subjected to the same receipt-of-money processing as in the well-known automatic teller machine (ATM). The operation of the money receiving means is executed here. In the automatic vending equipment of this embodiment, an article selling means, whose operation is executed by microcomputer processing, executes a predetermined processing.

The article selling means will now be described in detail. After an article A has been designated by the article designating keys 37 and the operation of the money receiving means has been executed, the article selling means performs a processing, which is executed by transmitting control signals from a CPU of the microcomputer to a driver for driving the X-axis motor 30, a driver for driving the Y-axis motor 32, a driver for driving the actuator drive motor 35 and a driver for driving the bottom plate drive motor 36, to drive the motors 30, 32, 35 and 36. First, the X- and Y-axis motors 30, 32 are driven to cause the bucket carrier 28 to slide along the bucket rails 27 and at the same time cause the bucket 6 to move vertically, thereby moving the bucket 6 up to the position opposed to the article storing compartment 9 which stores the designated article A. Thereafter, the actuator drive motor 35 is driven to rotate the actuator 34, allowing the actuator 34 to press the stopper displacing means 24, whereby the stopper 20 is moved to the article release position and the second stopper 21 to the article push-up position, allowing the designated article A to fall from the article storing compartment 9 and be held in the bucket 6. Thereafter, the X- and Y-axis motors 30, 32 are again driven to move the bucket 6 up to the position of the article take-out port PU. Subsequently, the bottom plate drive motor 36 is driven to open the bottom plate 6*a* of the bucket 6, allowing the article A to fall from the bucket 6 into the article take-out port P. These operations are executed by the article selling means.

In the case where plural articles A are designated, those articles are dropped into the bucket 6 in the manner described above and then the bucket moves to the position of the article take-out port PU. Where a large number of articles A incapable of being received in the bucket 6 at a time are designated, the bucket reciprocates twice or more between the associated article storing compartments 9 and the article take-out port PU.

The operation display section 8 is connected through the telephone line to the owner of the automatic vending equipment or to a totaling and management device disposed in a computer center or the like which manages the automatic vending equipment. Therefore, the owner of the automatic vending equipment or a person who manages the same equipment can grasp sales data at a position distant from the equipment.

In such a construction, when a customer who wants to buy an article A performed predetermined operations such as designation of article A and payment of money, the bucket 6 is conveyed from the article storing compartment 9 which stores the designated article A up to the position where the article A is to be dropped. The conveyance of the bucket 6 is performed by both movement of the bucket carrier 28 using the X-axis motor 30 as a drive source and a vertical movement of the bucket 6 using the Y-axis motor 32 as a drive source. After the designated article A has been dropped and held into the bucket 6, the bucket is conveyed up to the article take-out port PU, where the bottom plate **6*a* of the bucket 6 is opened, thereby allowing the article A to be dropped into the article take-out port PU and thus permitting the supply of the article A to the customer. A single transaction is now over. Where two or more articles A are designated, those articles are put and held into the bucket 6** successively in the same manner as above.

Next, the article dropping operation by the article dropping mechanism 19 will be described in detail. FIG. 3(A) shows a stand-by state. In this stand-by state, the stopper 20 is located at the article holding position to inhibit the fall of articles A1, A2, A3, ···, displayed on the article display shelf 5. On the other hand, the second stopper 21 is located at the article push-up cancel position, exerting no influence on the displayed articles A1, A2, A3, ···.

FIG. 3(B) shows a state in which an article to be bought is dropped in accordance with an article designating operation for the same article. When the article is to be dropped, the actuator 34 attached to the bucket 6 which faces the article storing compartment 9 is driven and presses the the stopper displacing means 24 in the article dropping mechanism 19. As a result, the pivotable member 23 moves pivotally in the direction of arrow a about the pivot shaft 22. With this pivotal motion the stopper 20 moves to the article release position lower than the surface of the article display shelf 5 and the second stopper 21 moves to the article push-up position projecting upward from the shelf surface. Upon movement of the stopper 20 to the article release position the article A1, tries to fall from the article display shelf 5. At this time, the second stopper 21 pushes the rear end side of the article A1, upward, whereby the article A1, is sure to be dropped. Then, the other articles A2,A3, ··· slide downward along the inclination of the article display shelf 5, but stop in abutment against the second stopper 21 which is in the article push-up position, whereby continuous fall of the second and other articles articles A2, A3, ··· is prevented.

When the actuator 34 is turned off and the article dropping mechanism 19 resumes its stand-by state, the second stopper 21 moves to the article push-up cancel position and the stopper 20 moves to the article holding position, so that the articles A2, A3, ··· which have been stopped by the second stopper 21 move down slightly along the inclination of the article display shelf 5 and are then held by the stopper 20, now ready for the next sale of articles.

At the time of connecting the stopper displacing means 24 to the link 26, it is possible to select any of the connection holes **26*a*, 26*b* and 26*c* to be connected. By this selection it becomes possible to adjust the position of the stopper 20 and that of the second stopper 21 in the stand-by state or in the article dropping state. For example, if the stopper displacing means 24 is connected to the connection hole 26*c*, the upward projection of the stopper 20 in the article holding position becomes smaller and that of the second stopper 21 in the article push-up position becomes larger. Therefore, when the height of article A displayed in an article storing compartment 9 of the article display shelf 5 is large or when the inclination angle of the article display shelf 5 is set large, the upward projection of the stopper 20** in the stand-by state is adjusted large so that the article A can be held surely.

The actuator 34 as a drive source for the article dropping mechanism 19 and the actuator drive motor 35 are attached to only the bucket 6. Consequently, number of components required for the drive source and associated wiring decreases markedly and the component cost becomes lower remarkably as compared with the case where the drive source for the article dropping mechanism is provided for each article storing compartment 9. Moreover, since the stopper 20 and the second stopper 21 each comprise two rods, the material cost is low and hence this structure is inexpensive.

Additionally, the stopper 20 is not an obstacle to observation of the displayed articles A1, A2, A3, ··· from the front side. It is easy to see the displayed articles.

The automatic vending equipment of this embodiment utilizes the interior wall surfaces of the room in which the equipment is installed, as rear plates which cover the back of the equipment, it is no longer required to newly provide rear plates, thus resulting in marked reduction in the number of components and the material cost. Particularly, the larger the size of the automatic vending equipment, the larger the degree of reduction in the material cost.

It is not that the automatic vending equipment of this embodiment is conveyed in an assembled state up to the place of installation and is installed there. The components of the equipment are conveyed into the room where the equipment is to be installed and are then assembled therein. Consequently, the transportation cost is greatly reduced. Further, this automatic vending equipment can be assembled in a size exactly matching the interior size of the room in which the equipment is to be installed, by a simple design modification such as adjusting the width of the plate-like article display shelf 5 and changing the spacing between adjacent rear frames 10 and that between adjacent front frames 12 accordingly.

Although the automatic vending equipment of this embodiment is turned square U-shaped in plan view utilizing three wall surfaces 1 in the interior of a room, its shape is not limited to such a shape. For example, the automatic vending machine may be I-shaped in plan view utilizing only one wall surface or L-shaped in plan view utilizing two wall surfaces in the interior of a room.

Although this embodiment utilizes the whole of a room as the automatic vending equipment, the same equipment may be installed utilizing only part of the room. As examples of places suitable for installing the automatic vending equipment by utilizing part of a room there are mentioned a lobby of a hotel, a stand house of a gas station, and a casino.

Figure 11:
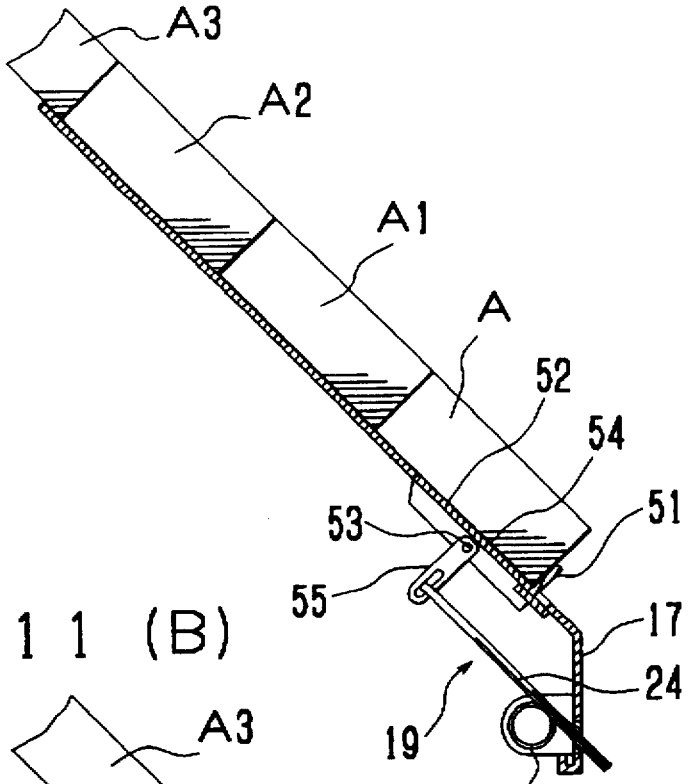
FIG. 11(A) is a side view in vertical section showing a modified example of an article dropping mechanism, which is in a stand-by state with a stopper located at an article holding position.
FIG. 11(B) is a side view in vertical section of the article dropping mechanism illustrated in FIG. 11(A), showing an article dropping state in which the stopper is located at an article release position.
Figure 11:
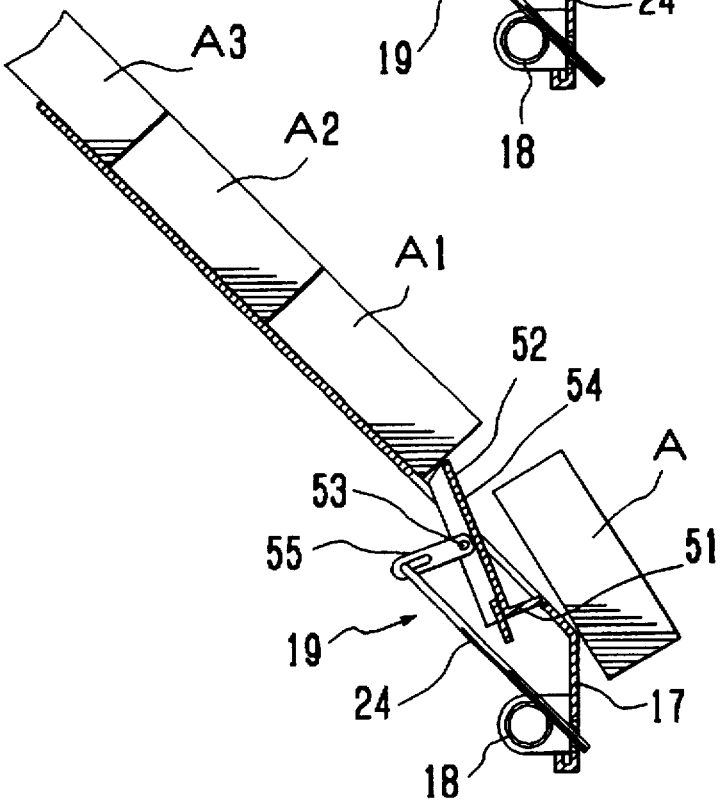

FIG. 11 shows a modification of the article dropping mechanism 19. The article dropping mechanism 19 according to this modification comprises a pair of stoppers 51, a second stopper 52, a rectangular plate-like pivotable member 54 which is pivotable about a pivot shaft 53, and a stopper displacing means 24 connected to the pivotable member 54. The stoppers 51, which are formed in a plate shape, are fixed to the lower end of the pivotable member 54. The upper end of the pivotable member 54 serves as the second stopper 52 which is movable between an article push-up position higher than the surface of an article display shelf 5 and an article push-up cancel position lower than the shelf surface. To the back of the pivotable member 54 is fixed a downwardly extending link 55, to which link is pivotably connected the stopper displacing means 24.

Figure 12:
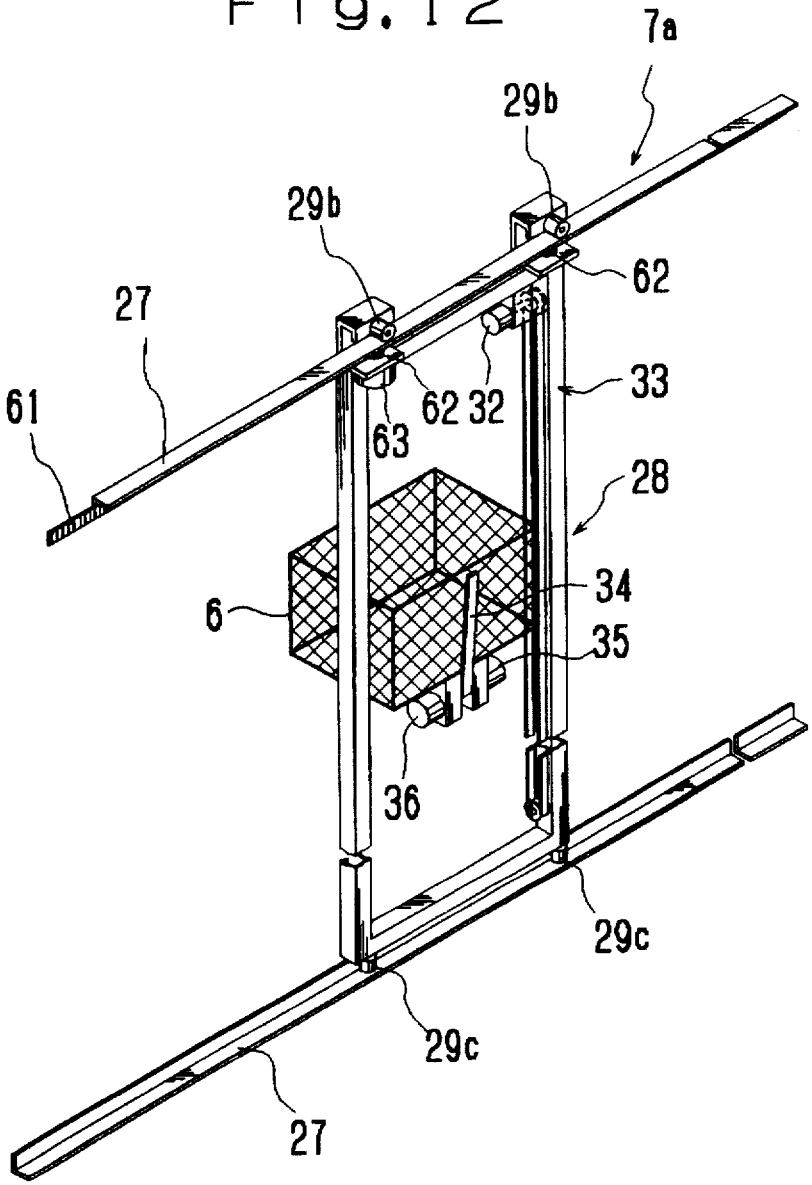
FIG. 12 is a perspective view basically showing a bucket conveying structure in a second embodiment of the present invention.
Figure 13:
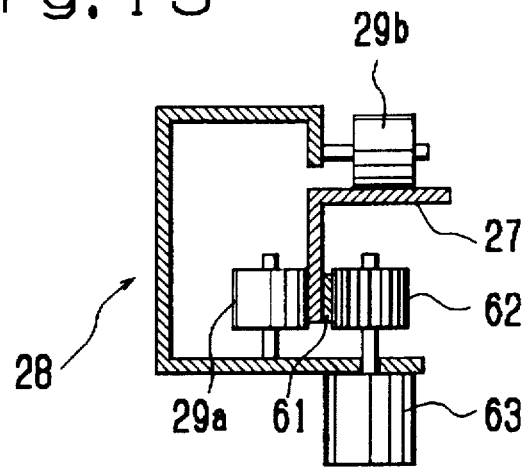
FIG. 13 is a side view in vertical section showing a structure for mounting a bucket carrier to a bucket rail.

A second embodiment of the present invention will now be described with reference to FIGS. 12 and 13. In these figures the same portions as in FIGS. 1 to 10 are indicated by the same reference numerals as in FIGS. 1 to 10 and explanations thereof are here omitted (this also applies to a further embodiment which follows). This embodiment is different from the previous first embodiment in point of using a bucket conveying means of a different structure. A bucket conveying means **7*a* used in this second embodiment has a pair of upper and lower rails 27 and a bucket carrier 28. The bucket carrier 28 is slidable along the bucket rails 27 and it holds a bucket 6 vertically movably. A timing belt 61, which is a linear gear, is affixed fixedly to a side face of the upper bucket rail 27. The bucket carrier 28 has two gears 62 meshing with the timing belt 61, rollers 29*a* opposed to the gears 62 to hold the upper bucket rail 27 therebetween, rollers 29*b* abutted against the upper surface of the bucket rail 27 to hold the bucket carrier 28 in a suspended state, rollers 29*c* which hold the lower bucket rail 27 therebetween, and an X-axis motor 63 as a gear driving unit for driving one gear 62. The bucket carrier 28 is provided with a Y-axis motor 32 and a Y-axis belt conveyor mechanism 33 which are for moving the bucket 6** vertically.

The bucket carrier 28 is further provided with a speaker or a sound source for making a sound to enhance an acoustic effect when the bucket carrier 28 slides along the bucket rails or when the bucket 6 moves vertically.

In such a construction, the timing belt 61 affixed fixedly to the upper bucket rail 27 is highly durable and becomes neither elongated nor damaged even after use over a long period. Besides, even at a bent portion of the bucket rail 27 the timing belt can be affixed to the rail along the bent shape. Consequently, the bucket carrier 28 can be moved smoothly and accurately along the upper and lower rails 27. Moreover, since the timing belt 61 is used in a fixedly affixed state to the upper bucket rail 27, the timing belt length required is reduced approximately to half, which leads to reduction of the cost. Further, it is possible to prevent the generation of noise caused by deflection of the timing belt during conveyance of the bucket carrier.

Figure 14:
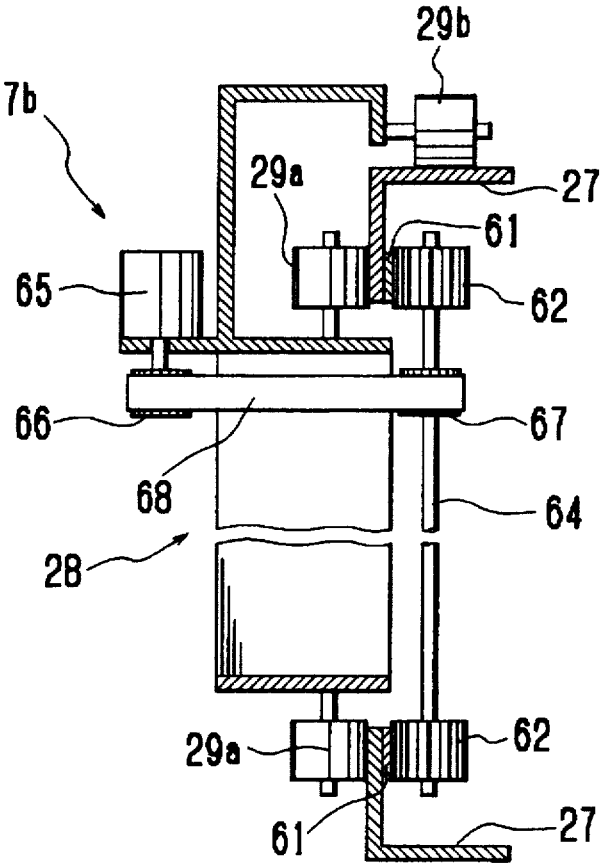
FIG. 14 is a side view in vertical section showing a structure for mounting a bucket carrier to bucket rails in a third embodiment of the present invention.

A third embodiment of the present invention will now be described with reference to FIG. 14. This third embodiment uses a bucket conveying means of a structure different from those used in the previous embodiments. A bucket conveying means **7*b* used in this embodiment has a pair of upper and lower bucket rails 27 and a bucket carrier 28. The bucket carrier 28 is slidable along the bucket rails 27 and it holds a bucket 6 vertically movably. A timing belt 61 as a linear gear is affixed fixedly to a side face of each of the upper and lower bucket rails 27. The bucket carrier 28 has two gears 62 meshing with the timing belts 61 at upper and lower positions, a plurality of rollers 29*a* opposed to the gears 62 to hold the upper and lower bucket rails 27 therebetween, rollers 29*b* abutted against the upper surface of the upper bucket rail 27 to hold the bucket carrier 28 in a suspended state, a rotating shaft 64 connecting one upper and lower gears 62 with each other, and an X-axis motor 65 as a gear driving unit for rotating the shaft 64 and the upper and lower gears 62. A timing belt 68 is entrained between and around a gear 66 fixed onto a motor shaft of the X-axis motor 65 and a gear 67 fixed onto the rotating shaft 64. The bucket carrier 28 is further provided with a Y-axis motor (not shown) and a ball screw (not shown) driven by the Y-axis motor both used for moving the bucket 6** vertically.

The bucket conveying means **7*b* used in this embodiment of the above construction is suitable for the case where the bucket carrier 28 and the bucket 6 are designed to be heavy so as to permit conveyance of heavy articles A. When the bucket carrier 28 slide along the bucket rails 27, the upper and lower gears 62 are driven in mesh with the timing belts 61 and therefore the bucket carrier 28 can be allowed to slide smoothly even with increase in weight of the bucket carrier 28 and the articles A carried in the bucket 6. Further, the use of a ball screw for moving the bucket 6** vertically permits the vertical movement of the bucket to be done smoothly even in the case of heavy articles A carried in the bucket.

Although in the above second and third embodiments the timing belt(s) 61 affixed fixedly to the bucket rail(s) 27 is used as a linear gear, a linear gear may be formed directly on a side face of the bucket rail 27 without using the timing belt 61.

A fourth embodiment of the present invention will now be described with reference to FIG. 15. This embodiment is different in the structure of an article take-out portion from the previous embodiments. Behind an article take-out port PU used in the automatic vending equipment of this embodiment there is provided a shutter 69 for opening and closing the article take-out port. A shutter drive motor (not shown) as a shutter driving unit is connected to the shutter 69. When the shutter drive motor is driven to open the shutter 69, the shutter moves pivotally about a pivot shaft 70 which has a horizontal axis, and assumes a front-declined state as indicated with a dash-double dot line.

Above the article take-out port PU is disposed a sensor switch (not shown) for detecting that the bucket carrier 28 has moved and stopped to the back side of the take-out port. In accordance with the result of detection provided from the sensor switch there is made a control to open the shutter 69 and a bottom plate **6*a* of a bucket 6 by means of a microcomputer disposed within an operation display section 8. When the bucket 6 has moved vertically up to the position for dropping the article(s) A carried in the interior of the bucket, both bottom plate 6*a* and shutter 69 are opened into such a continuous inclined state as indicated with dash-double dot lines. As a result, the article A carried in the bucket 6 slides on both bottom plate 6*a* and shutter 69 and falls onto the bottom portion of the article take-out port PU. Thus, it is no longer necessary for the customer who bought the article A to put his or her hand into the article take-out port PU or into the bucket 6 for taking out the article A. The article taking-out performance is thus improved. Besides, it is possible to surely prevent the occurrence of an accident caused by re-start of the bucket 6** while the customer's hand is still inside the bucket for taking out the article.

When the bottom plate **6*a* and the shutter 69 are opened for a predetermined time (e.g. 3 seconds), the bottom plate 6*a* and the shutter 69 are closed after the lapse of the predetermined time. Therefore, the article take-out port PU is closed with the shutter 69** while the selling of articles A is not performed. Thus, it is possible to prevent the articles A from being taken out by insertion of hand or an implement into the interior through the article take-out port PU.

Figure 15:
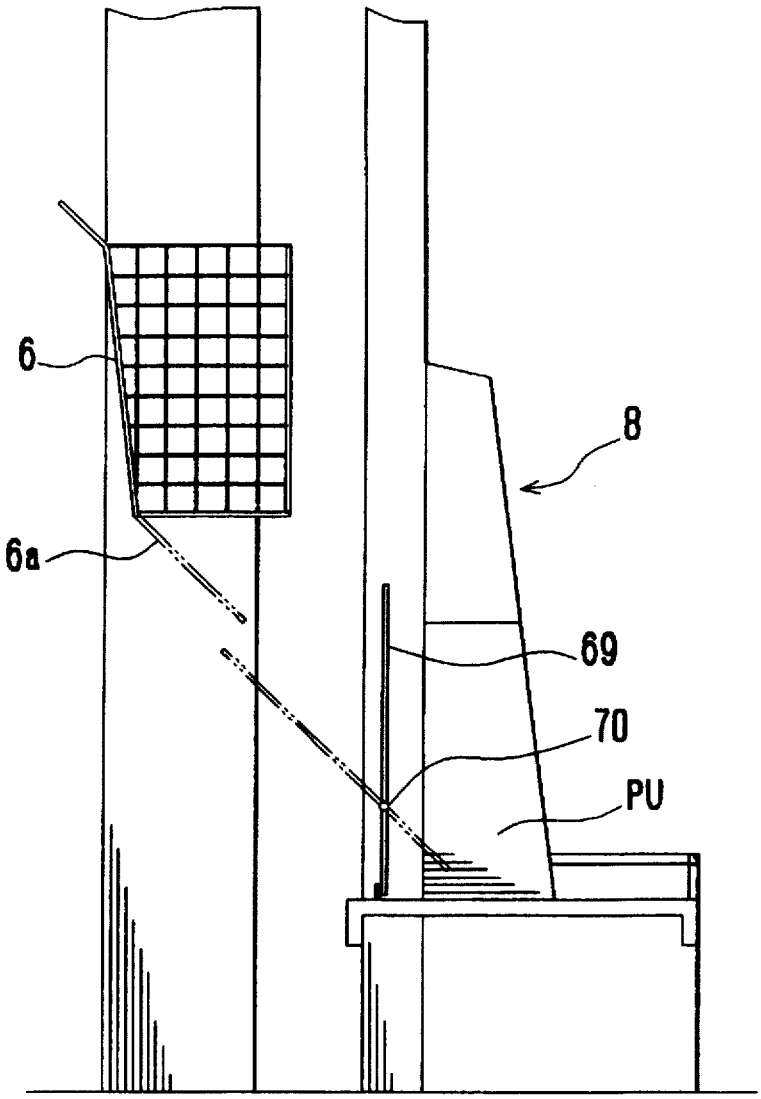
FIG. 15 is a side view in vertical section showing a structure of an article take-out portion in a fourth embodiment of the present invention.

Further, in the automatic vending equipment of this embodiment, as shown in FIG. 15, the operation display section 8 is disposed projectingly at the outside of a transparent panel 2. Inside the transparent panel 2, therefore, the operation display section 8 does not interfere with the bucket 6 which is moving. Therefore, it is not necessary that the bucket 6 be provided one for each of right and left sides of the operation display section 8.

The structures of the first to fourth embodiments described above are mere embodiments of the present invention. Accordingly, it is to be understood that the invention is not limited to those structures and that the invention covers all of embodiments included in the scope thereof.

What is claimed is:

1. An automatic vending equipment comprising:

article display shelves each including a plurality of article storing compartments formed in a matrix form vertically and laterally for holding a plurality of articles in a front-declined state;

an article dropping mechanism provided in each of said article storing compartments, said article dropping mechanism having a stopper capable of moving between an article holding position for inhibiting free fall of article and an article release position for permitting free fall of article, stopper urging means for urging said stopper to said article holding position, and stopper displacing means which when pressed displaces the stopper to said article release position;

an article take-out port for taking out articles;

bucket conveying means for conveying an article receiving bucket to an article dropping position where an article is dropped into said bucket from the article storing compartment which holds the article, and also to said article take-out port;

pressing means attached to said bucket to impart a pressing force to said stopper displacing means in said article dropping mechanism;

a front panel which covers all of said article display shelves, said article dropping mechanism and said bucket conveying means and which allows said article take-out port to be exposed;

article designating keys;

money receiving means; and article selling means which causes the bucket conveyance by said bucket conveying means and the displacement of said stopper to said article release position by said pressing means to be executed and which causes each article designated by said article designating keys to be conveyed up to said article take-out port on condition that the amount of money corresponding to the designated article is received by said money receiving means.

2. An automatic vending equipment as recited in claim 1, wherein said front panel constitutes part of interior wall surfaces of a room in which the automatic vending equipment is installed.

3. An automatic vending equipment as recited in claim 1, wherein said bucket conveying means includes bucket rails disposed in the horizontal direction, a bucket carrier which is slidable along said bucket rails and which holds said bucket in a vertically movable manner, a linear gear provided horizontally on one or both of said bucket rails, a gear attached to said bucket carrier and meshing with said linear gear, and a gear driving unit for driving the gear attached to the bucket carrier.

4. An automatic vending equipment as recited in claim 3, wherein said linear gear is a timing belt fixed to said bucket rail(s).

5. An automatic vending equipment as recited in claim 3, wherein said linear gear is formed integrally with said bucket rail(s).

6. An automatic vending equipment as recited in claim 1, wherein said article dropping mechanism further has a second stopper and a connection member, said second stopper being capable of moving between an article push-up position spaced a predetermined distance toward the back side from the position of said stopper in each said article storing compartment, in which article push-up position the second stopper projects to the article storing compartment side, and an article push-up cancel position where the second stopper does not project to the article snoring compartment side, said connection member connecting said stopper and said second stopper with each other in such a manner that the operation of the stopper and that of the second stopper are reverse to each other.

7. An automatic vending equipment as recited in claim 1, wherein said bucket has a bottom plate capable of being opened and closed and a bottom plate driving unit for opening and closing said bottom plate, and said article selling means causes the bucket with an article or articles put therein to be conveyed up to a position above said article take-out port and drives said bottom plate driving unit to open said bottom plate.

8. An automatic vending equipment as recited in claim 1, further including a shutter for opening and closing said article take-out port, said shutter assuming a front-declined state when opened, and a shutter driving unit for driving said shutter to let the shutter perform its opening and closing motions, and wherein said bucket has a bottom plate capable of being opened and closed, said bottom plate when opened assuming an inclined state contiguous to said shutter when the shutter is in its open condition, and a bottom plate driving unit for driving said bottom plate to let the bottom plate perform its opening and closing motions, and said article selling means causes said bucket with an article or articles put therein to be conveyed up to a position above and behind said article take-out port and drives said shutter driving unit and said bottom plate driving unit to open said shutter and said bottom plate.

9. An automatic vending equipment comprising:

article display shelves each including a plurality of article storing compartments formed in a matrix form vertically and laterally for holding a plurality of articles in a front-declined state;

an article dropping mechanism provided in each of said article storing compartments, said article dropping mechanism having a stopper capable of moving between an article holding position for inhibiting free fall of article and an article release position for permitting free fall of article, stopper urging means for urging said stopper to said article holding position, and stopper displacing means which when pressed displaces the stopper to said article release position;

an article take-out port for taking out articles;

a bucket support and moving mechanism for supporting an article receiving bucket movably to an article dropping position where an article is dropped into said bucket from the article storing compartment which holds the article, and also to said article take-out port;

a bucket driving unit for driving said bucket support and moving mechanism;

a pressing mechanism attached to said bucket and displaceable in a direction to impart a pressing force to said stopper displacing means in said article dropping mechanism;

a pressing mechanism driving unit for driving said pressing mechanism;

a front panel which covers all of said article display shelves, said article dropping mechanism and said bucket conveying means and which allows said article take-out port to be exposed;

article designating keys;

money receiving means; and article selling means which applies drive control signals to both said bucket driving unit and said pressing mechanism driving unit, thereby causing the bucket conveyance by said bucket support and moving mechanism and the displacement of said stopper to said article release position by said pressing mechanism to be executed and causing each article designated by said article designating keys to be conveyed up to said article take-out port on condition that the amount of money corresponding to the designated article is received by said money receiving means.

10. An automatic vending equipment as recited in claim 9, wherein said front panel constitutes part of interior wall surfaces of a room in which the automatic vending equipment is installed.

11. An automatic vending equipment as recited in claim 9, wherein said bucket support and moving mechanism comprises bucket rails disposed in the horizontal direction, a bucket carrier which is slidable along said bucket rails and which holds said bucket in a vertically movable manner, a linear gear provided horizontally on one or both of said bucket rails, a gear attached to said bucket carrier and meshing with said linear gear, and a gear driving unit for driving the gear attached to the bucket carrier.

12. An automatic vending equipment as recited in claim 11, wherein said linear gear is a timing belt fixed to said bucket rail(s).

13. An automatic vending equipment as recited in claim 11, wherein said linear gear is formed integrally with said bucket rail(s).

14. An automatic vending equipment as recited in claim 9, wherein said article dropping mechanism further has a second stopper and a connection member, said second stopper being capable of moving between an article push-up position spaced a predetermined distance toward the back side from the position of said stopper in each said article storing compartment, in which article push-up position the second stopper projects to the article storing compartment side, and an article push-up cancel position where the second stopper does not project to the article storing compartment side, said connection member connecting said stopper and said second stopper with each other in such a manner that the operation of the stopper and that of the second stopper are reverse to each other.

15. An automatic vending equipment as recited in claim 9, wherein said bucket has a bottom plate capable of being opened and closed and a bottom plate driving unit for opening and closing said bottom plate, and said article selling means applies a drive control signal to said bucket driving unit, thereby causing the bucket to be conveyed up to a position above said article take-out port, and said article selling means applies a drive control signal to said bottom plate driving unit to open said bottom plate.

16. An automatic vending equipment as recited in claim 9, further including a shutter for opening and closing said article take-out port, said shutter assuming a front-declined state when opened, and a shutter driving unit for driving said shutter to let the shutter perform its opening and closing motions, and wherein said bucket has a bottom plate capable of being opened and closed, said bottom plate when opened assuming an inclined state contiguous to said shutter when the shutter is in its open condition, and a bottom plate driving unit for driving said bottom plate to let the bottom plate perform its opening and closing motions, and said article selling means applies a drive control signal to said bucket driving unit, thereby causing the bucket to be conveyed up to a position above and behind said article take-out port, and said article selling means applies drive control signals to both said shutter driving unit and said bottom plate driving unit to open both said shutter and said bottom plate.

17. An automatic vending equipment comprising:

article display shelves each including a plurality of article storing compartments for holding a plurality of articles in an oblique state;

an article dropping mechanism provided in each of said article storing compartments, said article dropping mechanism having a stopper capable of moving between an article holding position for inhibiting free fall of article and an article release position for permitting free fall of article, stopper urging means for urging said stopper to said article holding position, and stopper displacing means which when pressed displaces the stopper to said article release position;

an article take-out port for taking out articles;

a bucket support and moving mechanism for supporting an article receiving bucket movably to an article dropping position where an article is dropped into said bucket from the article storing compartment which holds the article, and also to said article take-out port;

a bucket driving unit for driving said bucket support and moving mechanism;

a pressing mechanism attached to said bucket to impart a pressing force to said stopper displacing means in said article dropping mechanism;

a pressing mechanism driving unit for driving said pressing mechanism;

article designating means;

money receiving means; and article selling means which applies drive control signals to both said bucket driving unit and said pressing mechanism driving unit, thereby causing the bucket conveyance by said bucket conveying means and the displacement of said stopper to said article release position by said pressing mechanism to the executed and causing each article designated by said article designating keys to be conveyed up to said article take-out port on condition that the amount of money corresponding to the designated article is received by said money receiving means.

18. An automatic vending equipment as recited in claim 17, wherein said bucket conveying means comprises bucket rails disposed in the horizontal direction, a bucket carrier which is slidable along said bucket rails and which holds said bucket in a vertically movable manner, a linear gear provided horizontally on one or both of said bucket rails, a gear attached to said bucket carrier and meshing with said linear gear, and a gear driving unit for driving the gear attached to the bucket carrier.

19. An automatic vending equipment as recited in claim 18, wherein said linear gear is a timing belt fixed to said bucket rail(s).

20. An automatic vending equipment as recited in claim 18, wherein said linear gear is formed integrally with said bucket rail(s).

21. An automatic vending equipment as recited in claim 17, wherein said article dropping mechanism further has a second stopper and a connection member, said second stopper being capable of moving between an article push-up position spaced a predetermined distance toward the back side from the position of said stopper in each said article storing compartment, in which article push-up position the second stopper projects to the article storing compartment side, and an article push-up cancel position where the second stopper does not project to the article storing compartment side, said connection member connecting said stopper and said second stopper with each other in such a manner that the operation of the stopper and that of the second stopper are reverse to each other.

22. An automatic vending equipment as recited in claim 17, wherein said bucket has a bottom plate capable of being opened and closed and a bottom plate driving unit for opening and closing said bottom plate, and said article selling means applies a drive control signal to said bucket driving unit, thereby causing said bucket to be conveyed up to a position above said article take-out port, and said article selling means applies a drive control signal to said bottom plate driving unit to open said bottom plate.

23. An automatic vending equipment as recited in claim 17, further including a shutter for opening and closing said article take-out port, said shutter assuming a front-declined state when opened, and a shutter driving unit for driving said shutter to let the shutter perform its opening and closing motions, and wherein said bucket has a bottom plate capable of being opened and closed, said bottom plate when opened assuming an inclined state contiguous to said shutter when the shutter is in its open condition, and a bottom plate driving unit for driving said bottom plate to let the bottom plate perform its opening and closing motions, and said article selling means applies a drive control signal to said bucket driving unit, thereby causing said bucket to be conveyed up to a position above and behind said article take-out port, and said article selling means applies drive control signals to both said shutter driving unit and said bottom plate driving unit to open said shutter and said bottom plate.

* * * * *